US008642241B2

(12) United States Patent
Kamel et al.

(10) Patent No.: US 8,642,241 B2
(45) Date of Patent: Feb. 4, 2014

(54) MIXER APPARATUS AND METHOD OF MAKING DEVELOPER

(75) Inventors: Majid Kamel, North York (CA); Suxia Yang, Mississauga (CA); Richard P. N. Veregin, Mississauga (CA); Michael S. Hawkins, Cambridge (CA); Cuong Vong, Hamilton (CA); Santiago Faucher, Oakville (CA)

(73) Assignee: Xerox Corporation, Norwalk, CT (US)

( * ) Notice: Subject to any disclaimer, the term of this patent is extended or adjusted under 35 U.S.C. 154(b) by 154 days.

(21) Appl. No.: 13/333,426

(22) Filed: Dec. 21, 2011

(65) Prior Publication Data

US 2013/0164664 A1 Jun. 27, 2013

(51) Int. Cl.
*B01F 11/02* (2006.01)
*G03G 5/00* (2006.01)

(52) U.S. Cl.
USPC ..... 430/137.1; 430/123.41; 366/116

(58) Field of Classification Search
USPC ..... 430/123.41, 137.1; 366/114, 116
See application file for complete search history.

(56) References Cited

U.S. PATENT DOCUMENTS

| | | | | |
|---|---|---|---|---|
| 7,188,993 | B1 * | 3/2007 | Howe et al. | 366/111 |
| 2007/0141498 | A1 * | 6/2007 | Umehara | 430/108.21 |
| 2007/0238041 | A1 * | 10/2007 | Kobayashi et al. | 430/108.1 |

* cited by examiner

*Primary Examiner* — Thorl Chea
(74) *Attorney, Agent, or Firm* — Hoffman Warnick LLC

(57) ABSTRACT

The present teachings describe an apparatus for mixing developer. The apparatus includes a first loader for dispensing a predetermined amount of toner particles into a container and a second loader for dispensing a predetermined amount and carrier particles in the container. A sealer seals the container. An acoustic mixer is provided for mixing the container, toner particles and carrier particles at a resonant frequency. A method of mixing developer is disclosed.

10 Claims, 3 Drawing Sheets

MIXER APPARATUS AND METHOD OF MAKING DEVELOPER

BACKGROUND

1. Field of Use

The present disclosure relates to processes for producing developers, e.g. a mixture of toner particles and carrier particles suitable for electrostatographic apparatuses.

2. Background

This disclosure relates generally to developers for forming and developing images. More particularly, the disclosure is directed to developers that can be produced and packaged for shipment to customers in a cost effective manner.

Toners and developers containing toners are essential components of any electrophotographic image forming system. In conventional electrophotographic image forming systems, an image is first projected onto a photoreceptor by performing a charging process and an exposure process. An electrostatic latent image is formed on the photoreceptor by first charging developers and then shifting the charged toner particles of the developers to the photoreceptor to develop the electrostatic latent image. Next, the developed electrostatic latent image is transferred onto a recording medium, for example paper. Finally, a fixed electrostatic image is obtained by fusing the toners to the recording medium using heat, pressure and/or light.

One way for developing an electrostatic latent image is a one-component developing process using only a toner. Another way is known as a two-component developing process using a toner and a carrier. In the two-component developing process, the toner and the carrier are mixed to become electrically charged with opposite polarities through triboelectrification.

Currently developers are produced by mixing, the proper amount of toner and carrier. After each mixing and blending step the resulting developer is transferred to one or more packages for shipment to customers. The mixer or blender needs to be cleaned for the next batch to eliminate cross color contamination. This cleaning step obviously lowers the yield and manufacturing efficiency. The preparation, mixing, cleaning and packaging steps add to the cost, especially for small scale shipments. Thus, there is a need for improved developer preparation technology which would use less blending time, increase the yield, enable higher profit and capture new business opportunities.

SUMMARY

According to an embodiment, there is disclosed a process comprising loading a mixture of toner particles and carrier particles in a container and sealing the container. The mixture is mixed by acoustic mixing at a resonant frequency of the container, toner particles and carrier particles.

According to another embodiment, there is described an apparatus for mixing developer. The apparatus includes a first loader for dispensing a predetermined amount of toner particles into a container and a second loader for dispensing a predetermined amount of carrier particles in the container. A sealer seals the container. An acoustic mixer is provided for mixing the container, toner particles and carrier particles at a resonant frequency.

According to another embodiment there is provided an apparatus for mixing developer. The apparatus includes a first loader for dispensing a predetermined amount of polyester toner particles into a container. The apparatus includes a second loader for dispensing a predetermined amount of carrier particles into the container wherein the carrier particles comprise a core selected from the group consisting of a granular zircon, granular silicon, glass, steel, nickel, ferrites, iron ferrites and silicon dioxide. There is provided a sealer for sealing the container. An acoustic mixer is provided for vibrating the container, toner particles and carrier particles at a resonant frequency.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
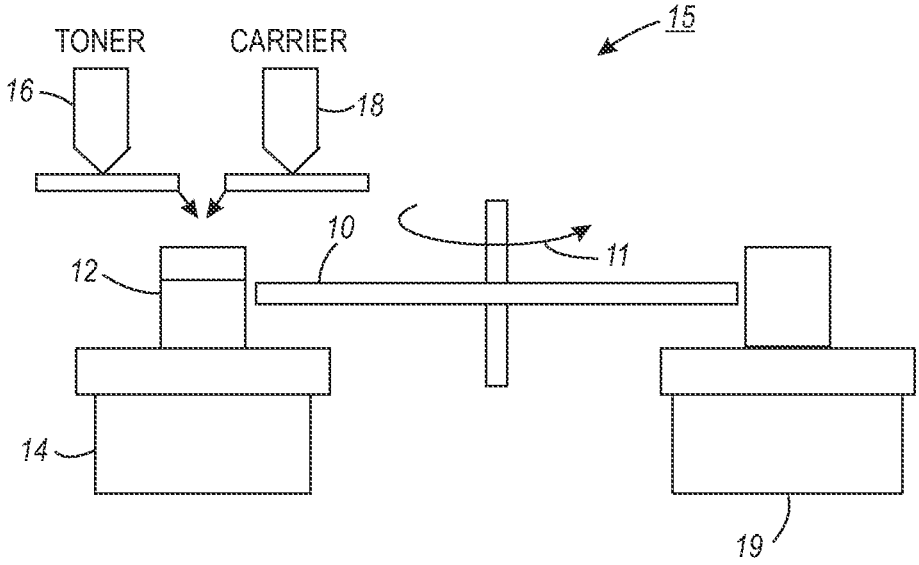
FIG. 1 illustrates an embodiment of an apparatus that performs container pick up, developer loading and weighing, developer mixing and final packaging for shipment.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Furthermore, to the extent that the terms "including", "includes", "having", "has", "with", or variants thereof are used in either the detailed description and the claims, such terms are intended to be inclusive in a manner similar to the term "comprising." The term "at least one of" is used to mean that one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

A method currently used for making developers is performed using a mixer available from TURBULA®. The TURBULA® is a shaker type mixer with an inert inner surface. Using a TURBULA® mixer, it typically takes 10 minutes to make a developer in the lab at a scale of about 50 grams to 500 grams of developer, while on scale-up, such as to an FM50 mixer (manufactured by Littleford) it will take 30 minutes at the production scale with the scale of about 10 Kg to 50 Kg developer. For producing developer for shipment to a customer, a proper amount of toner and carrier are weighted and dumped in the FM50 mixer and mixed for 30 minutes. The developer is then packaged before it is shipped to customers. After each developer blending, the FM50 mixer is thoroughly cleaned to eliminate cross color contamination. For small quantity specialty developers (e.g. custom colors), the production mixer is too large and a smaller mixer must be used. With small scale production, the preparation, mixing and cleaning cost is higher than with standard developers.

Disclosed herein is an apparatus that can prepare developer for shipment in a more efficient manner. The mixing and blending of the toner and carrier is quicker than with a shaker mixer and clean up of the mixer is completely eliminated. The apparatus weighs the proper amount of toner and carrier and loads the toner and carrier into a container. The container is sealed and mixed on an acoustic mixer at the resonant frequency of the assembly (container/bag and carrier and toner). The container is then discharged from the mixer and put on a conveying device for final packaging before shipment to a customer.

FIG. 1 shows the elements of the apparatus 15. The apparatus 15 weighs, mixes and packages developer for use in electrostatographic applications. FIG. 1 shows a rotating arm 10 that is configured to pick up a container 12. The arm rotates as shown by arrow 11 and positions the container 10 on a balance 14. A predetermined amount of toner is loaded into container 12 through loader 16. A predetermined amount of carrier is loaded into container 12 through loader 18. A balance 14 is optionally provided to ensure the proper amounts of developer and toner have been loaded into container 12. The container 12 is sealed and positioned on an acoustic mixer 19 by the rotating arm 10. The acoustic mixer 19 is set to the resonant frequency of the assembly which includes the container 12, the toner 16 and the carrier 18. The assembly is blended at the resonant frequency for 15 seconds to about 3 minutes, or from about 20 seconds to about 2 minutes or from about 30 seconds to about 1.5 minutes. The container 12 containing the developer (toner and carrier) is moved by the arm 10 from the acoustic mixer 19 to a packaging station (not shown) before final packaging and shipment to customers. The four steps (container pickup, developer loading and weighing, developer mixing and final packaging) can be performed by a single machine to provide an efficient process which reduces cost.

According to an embodiment, there is disclosed a process for mixing a developer. The process includes loading a mixture of toner particles and carrier particles in a container and sealing the container. The mixture is mixed by acoustic mixing at a resonant frequency of the container, toner particles and carrier particles.

The container utilized in the method and apparatus described herein can be a plastic bag, metal container, glass container or any other sealable container. The container after mixing is ready for shipment without further processing.

The developer composition is formulated by mixing toner particles and carrier particles to achieve a two-component developer composition. The toner concentration in the developer may be from about 1% to about 25% by weight of the total weight of the developer, in embodiments from about 2% to about 15% by weight of the total weight of the developer, in embodiments from about 3% to about 13% by weight of the total weight of the developer.

Resonant acoustic mixing is distinct from conventional impeller agitation found in a planetary mixer or ultrasonic mixing. Low frequency, high-intensity acoustic energy is used to create a uniform shear field throughout the entire mixing vessel. The result is rapid fluidization (like a fluidized bed) and dispersion of material.

Resonant acoustic mixing differs from ultrasonic mixing in that the frequency of acoustic energy is orders of magnitude lower. As a result, the scale of mixing is larger. Unlike impeller agitation, which mixes by inducing bulk flow, the acoustic mixing occurs on a microscale throughout the mixing volume.

In acoustic mixing, acoustic energy is delivered to the components to be mixed. An oscillating mechanical driver creates motion in a mechanical system comprised of engineered plates, eccentric weights and springs. This energy is then acoustically transferred to the material to be mixed. The underlying technology principle is that the system operates at resonance. In this mode, there is a nearly complete exchange of energy between the mass elements and the elements in the mechanical system.

In a resonant acoustic mixing, the only element that absorbs energy (apart from some negligible friction losses) is the mix load itself. Thus, the resonant acoustic mixing provides a highly efficient way of transferring mechanical energy directly into the mixing materials. In the mixing of developer, the resonant frequency is the container and its contents, i.e. the toner particles and the carrier particles. The resonant frequency can be from about 15 Hertz to about 2000 Hertz, or in embodiments from about 20 Hertz to about 1800 Hertz, or from about 20 Hertz to about 1700 Hertz. The g force applied by the acoustic mixer to the mix load can be from about 2 g force to about 100 g force.

Resonant acoustic mixers are available from Resodyn™ Acoustic Mixers.

Toners suitable for blending with carriers may include a resin in combination with a pigment. While the latex resin may be prepared by any method within the purview of those skilled in the art, in embodiments the latex resin may be prepared by emulsion polymerization methods, including semi-continuous emulsion polymerization, and the toner may include emulsion aggregation toners. Emulsion aggregation involves aggregation of both submicron latex and pigment particles into toner size particles, where the growth in particle size is, for example, in embodiments from about 0.1 micron to about 15 microns.

Resins

Any toner resin may be utilized in the present disclosure. Such resins, in turn, may be made of any suitable monomer or monomers via any suitable polymerization method. In embodiments, the resin may be prepared by a method other than emulsion polymerization. In further embodiments, the resin may be prepared by condensation polymerization.

The toner composition can include an amorphous resin. The amorphous resin may be linear or branched. In embodiments, the amorphous resin may include at least one low molecular weight amorphous polyester resin. The low molecular weight amorphous polyester resins, which are available from a number of sources, can possess various melting points of, for example, from about 30° C. to about 120° C., in embodiments from about 75° C. to about 115° C., in embodiments from about 100° C. to about 110° C., and/or in embodiments from about 104° C. to about 108° C.

Examples of linear amorphous polyester resins which may be utilized include poly(propoxylated bisphenol A co-fumarate), poly(ethoxylated bisphenol A co-fumarate), poly(butyloxylated bisphenol A co-fumarate), poly(co-propoxylated bisphenol A co-ethoxylated bisphenol A co-fumarate), poly (1,2-propylene fumarate), poly(propoxylated bisphenol A co-maleate), poly(ethoxylated bisphenol A co-maleate), poly (butyloxylated bisphenol A co-maleate), poly(co-propoxylated bisphenol A co-ethoxylated bisphenol A co-maleate), poly(1,2-propylene maleate), poly(propoxylated bisphenol A co-itaconate), poly(ethoxylated bisphenol A co-itaconate), poly(butyloxylated bisphenol A co-itaconate), poly(co-propoxylated bisphenol A co-ethoxylated bisphenol A co-itaconate), poly(1,2-propylene itaconate), and combinations thereof.

In embodiments, the low molecular weight amorphous polyester resin may be a saturated or unsaturated amorphous polyester resin. Illustrative examples of saturated and unsaturated amorphous polyester resins selected for the process and particles of the present disclosure include any of the various amorphous polyesters, such as polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene- isophthalate, polypropylene-isophthalate, polybutylene- isophthalate, polypentylene-isophthalate, polyhexalene- isophthalate, polyheptadene-isophthalate, polyoctalene- isophthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(ethoxylated bisphenol A-fumarate), poly (ethoxylated bisphenol A-succinate), poly(ethoxylated bisphenol A-adipate), poly(ethoxylated bisphenol A-glutarate), poly(ethoxylated bisphenol A-terephthalate), poly (ethoxylated bisphenol A-isophthalate), poly(ethoxylated bisphenol A-dodecenylsuccinate), poly(propoxylated bisphenol A-fumarate), poly(propoxylated bisphenol A-succinate), poly(propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate), SPAR (Dixie Chemicals), BECKOSOL (Reichhold Inc), ARAKOTE (Ciba-Geigy Corporation), HETRON (Ashland Chemical), PARAPLEX (Rohm & Haas), POLYLITE (Reichhold Inc), PLASTHALL (Rohm & Haas), CYGAL (American Cyanamide), ARMCO (Armco Composites), ARPOL (Ashland Chemical), CELANEX (Celanese Eng), RYNITE (DuPont), STYPOL (Freeman Chemical Corporation) and combinations thereof. The resins can also be functionalized, such as carboxylated, sulfonated, or the like, and particularly such as sodio sulfonated, if desired.

The low molecular weight amorphous polyester resin may be a branched resin. As used herein, the terms "branched" or "branching" includes branched resin and/or cross-linked resins. Branching agents for use in forming these branched resins include, for example, a multivalent polyacid such as 1,2,4-benzene- tricarboxylic acid, 1,2,4-cyclo hexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

In embodiments, the low molecular weight amorphous polyester resin or a combination of low molecular weight amorphous resins may have a glass transition temperature of from about 30° C. to about 80° C., in embodiments from about 35° C. to about 70° C. In further embodiments, the combined amorphous resins may have a melt viscosity of from about 10 to about 1,000,000 Pa*S at about 130° C., in embodiments from about 50 to about 100,000 Pa*S.

The amount of the low molecular weight amorphous polyester resin in a toner particle of the present disclosure, whether in core, any shell, or both, may be present in an amount of from 25 to about 50 percent by weight, in embodiments from about 30 to about 45 percent by weight, and in embodiments from about 35 to about 43 percent by weight, of the toner particles (that is, toner particles exclusive of external additives and water).

In embodiments, the toner composition includes at least one crystalline resin. As used herein, "crystalline" refers to a polyester with a three dimensional order. "Semicrystalline resins" as used herein refers to resins with a crystalline percentage of, for example, from about 10 to about 90%, or in embodiments from about 12 to about 70%. Further, as used hereinafter "crystalline polyester resins" and "crystalline resins" encompass both crystalline resins and semicrystalline resins, unless otherwise specified.

In embodiments, the crystalline polyester resin is a saturated crystalline polyester resin or an unsaturated crystalline polyester resin.

Illustrative examples of crystalline polyester resins may include any of the various crystalline polyesters, such as poly(ethylene-adipate), poly(propylene-adipate), poly(butylene-adipate), poly(pentylene-adipate), poly(hexylene-adipate), poly(octylene-adipate), poly(ethylene-succinate), poly (propylene-succinate), poly(butylene-succinate), poly (pentylene-succinate), poly (hexylene-succinate), poly (octylene-succinate), poly (ethylene-sebacate), poly (propylene-sebacate), poly (butylene-sebacate), poly (pentylene-sebacate), poly (hexylene-sebacate), poly (octylene-sebacate), poly (nonylene-sebacate), poly (decylene-sebacate), poly(undecylene-sebacate), poly (dodecylene-sebacate), poly(ethylene-dodecanedioate), poly (propylene-dodecanedioate), poly(butylene-dodecanedioate), poly(pentylene-dodecanedioate), poly (hexylene-dodecanedioate), poly (octylene-dodecanedioate), poly(nonylene-dodecanedioate), poly(decylene-dodecandioate), poly(undecylene-dodecandioate), poly(dodecylene-dodecandioate), poly(ethylene-fumarate), poly(propylene-fumarate), poly (butylene-fumarate), poly(pentylene-fumarate), poly(hexylene-fumarate), poly(octylene-fumarate), poly(nonylene- fumarate), poly(decylene-fumarate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate) and combinations thereof.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpoly-ethoxyethyl methacrylate), poly(ethylene adipate), poly (decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), poly(p-xylylene pimelamide), and combinations thereof.

The amount of the crystalline polyester resin in a toner particle of the present disclosure, whether in core, shell or both, may be present in an amount of from 1 to about 15 percent by weight, in embodiments from about 5 to about 10 percent by weight, and in embodiments from about 6 to about 8 percent by weight, of the toner particles (that is, toner particles exclusive of external additives and water).

In embodiments, a toner of the present disclosure may also include at least one high molecular weight branched or cross-linked amorphous polyester resin. This high molecular weight resin may include, in embodiments, for example, a branched amorphous resin or amorphous polyester, a cross-linked amorphous resin or amorphous polyester, or mixtures thereof, or a non-cross-linked amorphous polyester resin that has been subjected to cross-linking In accordance with the present disclosure, from about 1% by weight to about 100% by weight of the high molecular weight amorphous polyester resin may be branched or cross-linked, in embodiments from about 2% by weight to about 50% by weight of the higher molecular weight amorphous polyester resin may be branched or cross-linked.

The high molecular weight amorphous resins, which are available from a number of sources, can possess various onset glass transition temperatures (Tg) of, for example, from about 40° C. to about 80° C., in embodiments from about 50° C. to about 70° C., and in embodiments from about 54° C. to about 68° C., as measured by differential scanning calorimetry (DSC). The linear and branched amorphous polyester resins, in embodiments, may be a saturated or unsaturated resin.

The high molecular weight amorphous polyester resins may prepared by branching or cross-linking linear polyester resins. Branching agents can be utilized, such as trifunctional or multifunctional monomers, which agents usually increase the molecular weight and polydispersity of the polyester. Suitable branching agents include glycerol, trimethylol ethane, trimethylol propane, pentaerythritol, sorbitol, diglycerol, trimellitic acid, trimellitic anhydride, pyromellitic acid, pyromellitic anhydride, 1,2,4-cyclohexanetricarboxylic acid, 2,5,7-naphthalenetricarboxylic acid, 1,2,4-butanetricarboxylic acid, combinations thereof, and the like. These branching agents can be utilized in effective amounts of from about 0.1 mole percent to about 20 mole percent based on the starting diacid or diester used to make the resin.

Compositions containing modified polyester resins with a polybasic carboxylic acid which may be utilized in forming high molecular weight polyester resins include those disclosed in U.S. Pat. No. 3,681,106, as well as branched or cross-linked polyesters derived from polyvalent acids or alcohols as illustrated in U.S. Pat. Nos. 4,863,825; 4,863,824; 4,845,006; 5,143,809; 5,057,596; 4,988,794; 4,981,939; 4,980,448; 4,933,252; 4,931,370; 4,917,983 and 4,973,539, the disclosures of each of which are incorporated by reference herein in their entirety.

In embodiments, cross-linked polyesters resins may be made from linear amorphous polyester resins that contain sites of unsaturation that can react under free-radical conditions. Examples of such resins include those disclosed in U.S. Pat. Nos. 5,227,460; 5,376,494; 5,480,756; 5,500,324; 5,601,960; 5,629,121; 5,650,484; 5,750,909; 6,326,119; 6,358,657; 6,359,105; and 6,593,053, the disclosures of each of which are incorporated by reference in their entirety. In embodiments, suitable unsaturated polyester base resins may be prepared from diacids and/or anhydrides such as, for example, maleic anhydride, terephthalic acid, trimelltic acid, fumaric acid, and the like, and combinations thereof, and diols such as, for example, bisphenol-A ethyleneoxide adducts, bisphenol A-propylene oxide adducts, and the like, and combinations thereof. In embodiments, a suitable polyester is poly (propoxylated bisphenol A co-fumaric acid).

In embodiments, a cross-linked branched polyester may be utilized as a high molecular weight amorphous polyester resin. Such polyester resins may be formed from at least two pre-gel compositions including at least one polyol having two or more hydroxyl groups or esters thereof, at least one aliphatic or aromatic polyfunctional acid or ester thereof, or a mixture thereof having at least three functional groups; and optionally at least one long chain aliphatic carboxylic acid or ester thereof, or aromatic monocarboxylic acid or ester thereof, or mixtures thereof. The two components may be reacted to substantial completion in separate reactors to produce, in a first reactor, a first composition including a pre-gel having carboxyl end groups, and in a second reactor, a second composition including a pre-gel having hydroxyl end groups. The two compositions may then be mixed to create a cross-linked branched polyester high molecular weight resin.

Examples of such polyesters and methods for their synthesis include those disclosed in U.S. Pat. No. 6,592,913, the disclosure of which is hereby incorporated by reference in its entirety.

In embodiments, the high molecular weight resin, for example a branched polyester, may be present on the surface of toner particles. The high molecular weight resin on the surface of the toner particles may also be particulate in nature, with high molecular weight resin particles having a diameter of from about 100 nanometers to about 300 nanometers, in embodiments from about 110 nanometers to about 150 nanometers.

The amount of high molecular weight amorphous polyester resin in a toner particle, whether in the core, any shell, or both, may be from about 25% to about 50% by weight of the toner, in embodiments from about 30% to about 45% by weight, in other embodiments or from about 40% to about 43% by weight of the toner (that is, toner particles exclusive of external additives and water).

The ratio of crystalline resin to the low molecular weight amorphous resin to high molecular weight amorphous polyester resin can be in the range from about 1:1:98 to about 98:1:1 to about 1:98:1, in embodiments from about 1:5:5 to about 1:9:9, or in embodiments from about 1:6:6 to about 1:8:8.

Surfactants

In embodiments, resins, waxes, and other additives utilized to form toner compositions may be in dispersions including surfactants. Moreover, toner particles may be formed by emulsion aggregation methods where the resin and other components of the toner are placed in one or more surfactants, an emulsion is formed, and toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Toner

The resin of the resin emulsions described above, in embodiments a polyester resin, may be utilized to form toner compositions. Such toner compositions may include optional colorants, optional waxes, and other additives. Toners may be formed utilizing any method within the purview of those skilled in the art including, but not limited to, emulsion aggregation methods.

Colorants

The particles produced as described above may be added to a colorant to produce a toner. In embodiments the colorant may be in a dispersion. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. Suitable surfactants include any of those surfactants described above. In embodiments, the surfactant may be ionic and may be present in a dispersion in an amount from about 0.1 to about 25 percent by weight of the colorant, and in embodiments from about 1 to about 15 percent by weight of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or mixtures thereof.

Wax

Optionally, a wax may also be combined with the resin in forming toner particles. When included, the wax may be present in an amount of, for example, from about 1 weight percent to about 25 weight percent of the toner particles, in embodiments from about 5 weight percent to about 20 weight percent of the toner particles.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

Carrier

Various suitable solid core materials can be utilized for the carriers and developers of the present disclosure. Characteristic core properties include those that, in embodiments, will enable the toner particles to acquire a positive charge or a negative charge, and carrier cores that will permit desirable flow properties in the developer reservoir present in an electrophotographic imaging apparatus. Other desirable properties of the core include, for example, suitable magnetic characteristics that permit magnetic brush formation in magnetic brush development processes; desirable mechanical aging characteristics; and desirable surface morphology to permit high electrical conductivity of any developer including the carrier and a suitable toner.

Examples of carrier cores that can be utilized include iron and/or steel, such as atomized iron or steel powders available from Hoeganaes Corporation or Pomaton S.p.A (Italy); ferrites such as Cu/Zn-ferrite containing, for example, about 11 percent copper oxide, about 19 percent zinc oxide, and about 70 percent iron oxide, including those commercially available from D.M. Steward Corporation or Powdertech Corporation, Ni/Zn-ferrite available from Powdertech Corporation, Sr (strontium)-ferrite, containing, for example, about 14 percent strontium oxide and about 86 percent iron oxide, commercially available from Powdertech Corporation, and Ba-ferrite; magnetites, including those commercially available from, for example, Hoeganaes Corporation (Sweden); nickel; combinations thereof, and the like. In embodiments, the polymer particles obtained can be used to coat carrier cores of any known type by various known methods, and which carriers are then incorporated with a known toner to form a developer for electrophotographic printing. Other suitable carrier cores are illustrated in, for example, U.S. Pat. Nos. 4,937,166, 4,935,326, and 7,014,971, the disclosures of each of which are hereby incorporated by reference in their entirety, and may include granular zircon, granular silicon, glass, silicon dioxide, combinations thereof, and the like. In embodiments, suitable carrier cores may have an average particle size of, for example, from about 20 microns to about 400 microns in diameter, in embodiments from about 40 microns to about 200 microns in diameter.

In embodiments, a ferrite may be utilized as the core, including a metal such as iron and at least one additional metal such as copper, zinc, nickel, manganese, magnesium, calcium, lithium, strontium, zirconium, titanium, tantalum, bismuth, sodium, potassium, rubidium, cesium, strontium, barium, yttrium, lanthanum, hafnium, vanadium, niobium, aluminum, gallium, silicon, germamium, antimony, combinations thereof, and the like.

The polymeric coating on at least a portion of the surface of the core metal includes a latex. In embodiments, a latex copolymer utilized as the coating of a carrier core may include at least one acrylate, methacrylate, combinations thereof, and the like, and a cation binding monomer. In embodiments, the acrylate may be an aliphatic cycloacrylate. Suitable acrylates and/or methacrylates which may be utilized in forming the polymer coating include, for example, methyl methacrylate, cyclohexylmethacrylate, cyclopropyl acrylate, cyclobutyl acrylate, cyclopentyl acrylate, cyclohexyl acrylate, cyclopropyl methacrylate, cyclobutyl methacrylate, cyclopentyl methacrylate, isobornyl methacrylate, isobornyl acrylate, combinations thereof, and the like. In embodiments, a polymeric coating for the carrier core may include a copolymer derived from an aliphatic cycloacrylate and at least one additional acrylate. In other embodiments, a coating may include a copolymer of cyclohexylmethacrylate with isobornyl methacrylate, with the cyclohexylmethacrylate present in an amount of from about 0.1 percent to about 99.9% by weight of the copolymer, in embodiments from about 35 percent to about 65% by weight of the copolymer, with the isobornyl methacrylate present in an amount from about 99.9 percent to about 0.1% by weight of the copolymer, in embodiments from about 65 percent to about 35% by weight of the copolymer.

In some embodiments, the carrier coating may include a conductive component. Suitable conductive components include, for example, carbon black.

There may be added to the carrier a number of additives, for example, charge enhancing additives, including particulate amine resins, such as melamine, and certain fluoropolymer powders, such as alkyl-amino acrylates and methacrylates, polyamides, and fluorinated polymers, such as polyvinylidine fluoride and poly(tetrafluoroethylene), and fluoroalkyl methacrylates, such as 2,2,2-trifluoroethyl methacrylate. Other charge enhancing additives which may be utilized include quaternary ammonium salts, including distearyl dimethyl ammonium methyl sulfate (DDAMS), bis[1-[3,5-disubstituted-2-hydroxyphenyl)azo]-3-(mono-substituted)-2-naphthalenolato(2-)]chromate(1-), ammonium sodium and hydrogen (TRH), cetyl pyridinium chloride (CPC), FANAL PINK® D4830, combinations thereof, and the like, and other effective known charge agents or additives. The charge additive components may be selected in various effective amounts, such as from about 0.5 weight percent to about 20 weight percent, and from about 1 weight percent to about 3 weight percent, based, for example, on the sum of the weights of polymer/copolymer, conductive component, and other charge additive components.

While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

EXAMPLES

Example 1

Preparation of a Black Developer

A black emulsion aggregation toner was prepared at the 20 gal scale (11 kg dry theoretical toner). Two amorphous polyester emulsions (5.06 kg of an amorphous polyester resin in an emulsion (polyester emulsion A), having a Mw of about 19,400, an Mn of about 5,000, and a Tg onset of about 60° C., and about 35% solids and 7.62 kg of an amorphous polyester resin in an emulsion (polyester emulsion B), having a weight average molecular weight (Mw) of about 86,000, a number average molecular weight (Mn) of about 5,600, an onset glass transition temperature (Tg onset) of about 56° C., and about 35% solids), 2.2 kg of a crystalline polyester emulsion (having a Mw of about 23,300, an Mn of about 10,500, a melting temperature (Tm) of about 71° C., and about 35.4% solids), 3.2 kg of polyethylene wax in an emulsion, having a Tm of about 90° C., and about 30% solids, 6.04 kg black pigment dispersion (NIPEX-35, obtained from Evonik Degussa, Parsippany, N.J.), and 1.02 kg cyan pigment dispersion (Pigment Blue 15:3, about 17% solids, obtained from Sun Chemical Corporation) were mixed. Both amorphous resins were of the formula

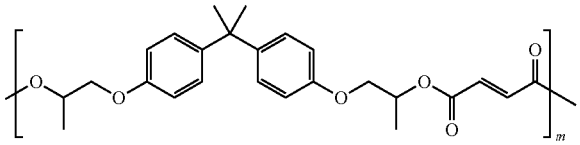

wherein m is from about 5 to about 1000. The crystalline resin was of the formula

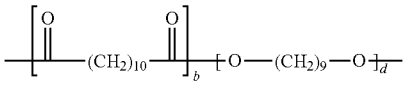

wherein b is from about 5 to about 2000 and d is from about 5 to about 2000.

Thereafter, the pH was adjusted to 4.2 using 0.3M nitric acid. The slurry was then homogenized for a total of 40 minutes at 3000-4000 rpm while adding in the coagulant (197g $Al_2(SO_4)_3$ mixed with 2.44 kg deionized water). The slurry mixing was set at 250 rpm. Thereafter, the slurry was aggregated at a batch temperature of 42° C. During aggregation, a shell comprising the same amorphous emulsions as in the core was pH adjusted to 3.3 with nitric acid and added to the batch. The batch then continued to achieve the targeted particle size. Once at the target particle size with pH adjustment to 7.8 using NaOH and EDTA, the aggregation step was frozen. The process proceeded with the reactor temperature being increased to achieve 70° C.; at the desired temperature the pH was adjusted to 6.45 using pH 5.7 sodium acetate/acetic acid buffer where the particles began to coalesce. After about one hour the particles achieved a circularity of >0.965 and were quench-cooled using a heat exchanger. The toner was washed with three deionized water washes at room temperature and dried using flash dryer. Final toner particle size, GSDv and GSDn were 5.36 μm, 1.22, 1.24, respectively. Fines (1.3-4 μm), coarse (>16 μm), and circularity were 22.38%, 0.1%, and 0.952.

Figure 2:
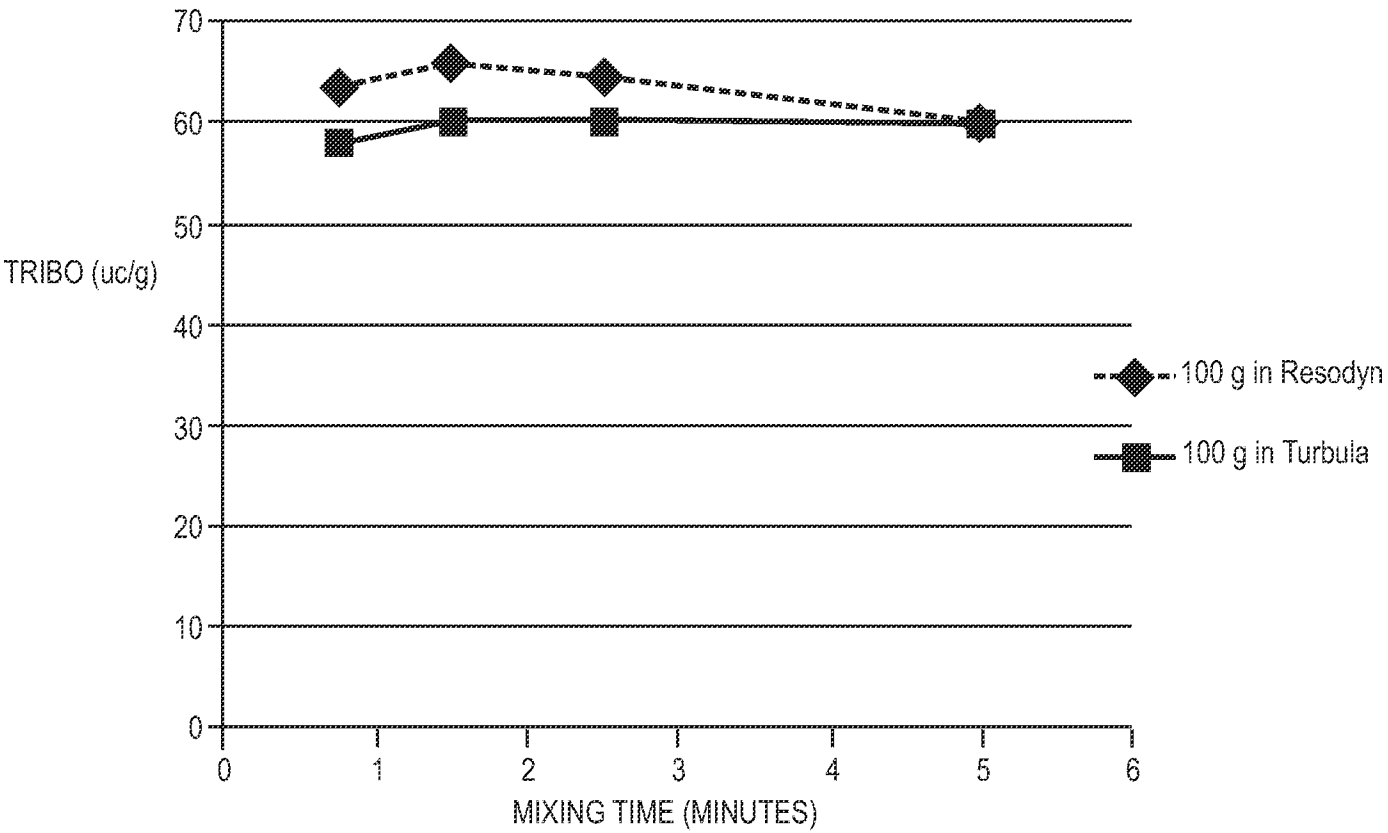
FIG. 2. shows the developer charge (μc/g) versus mixing time for four developer samples prepared with an acoustic mixer (Resodyn™) and a standard lab mixer (TURBULA®).
Figure 3:
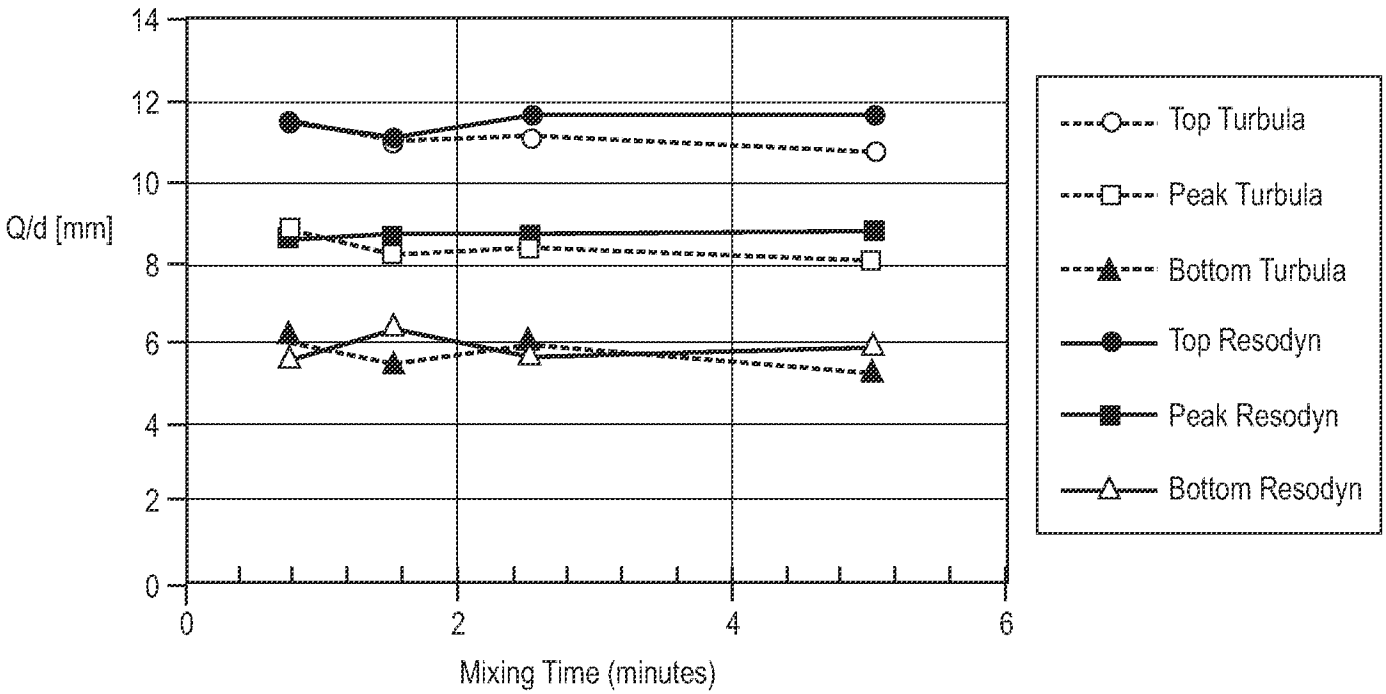
FIG. 3. shows the peak, midpoint and bottom developer charge (μc/g) versus mixing time for four developer samples prepared with an acoustic mixer (Resodyn™) and a standard lab mixer (TURBULA®) as shown in FIG. 2.

Eight grams of the black toners and 92 grams of Xerox 700 carriers were weighed out and loaded into a 500 ml polyethylene bottle. The toner and carrier were placed in the resonant acoustic mixer (eg. Resodyn™ LabRAM 500 g model). After switching the machine on, the machine automatically searched and locked at the resonant frequency 61.13 Hz. Four samples were mixed on this acoustic mixer for 0.75, 1.5, 2.5 and 5 minutes respectively at intensity 90% (acceleration 92 G, where 1 G is the acceleration of the earth's gravity or 9.81 $m/sec^2$). The tribo (q/m) and q/d measurements were taken for each sample as shown in FIG. 2. The q/m was measured with a standard blow-off method. The developer charge q/d was measured using a charge spectrograph using a 100 V/cm field. The developer charge (q/d) was recorded visually as the midpoint of the toner charge distribution, usually in millimeters of displacement from the zero line. FIG. 3 shows the top peak (midpoint) and bottom of the developer charge for each sample in FIG. 2.

It can be seen from FIG. 2 that the acoustic mixer gives faster charging compared to the standard lab mixer (TURBULA®). The overall slightly higher charge suggests that the mixing is very efficient and effective. From the tribo data, 45 seconds or less is sufficient time to mix and charge up the developer to the same level as it would take TURBULA® lab mixer 5 minutes to accomplish. The peak charge is reached around 1.5 minutes. On scale-up, the mix time goes from 10 minutes on the TURBULA® lab mixer to 30 minutes on FM-50 production mixer. According to the literature for the Resodyn™, the mix time at larger scale on the Resodyn is not dependant on scale, so production scale would require less than 45 seconds.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled the in the art which are also encompassed by the following claims.

What is claimed is:

1. An apparatus for mixing developer comprising:

a first loader for dispensing a predetermined amount of toner particles into a container a second loader for dispensing a predetermined amount of carrier particles into the container;

a sealer for sealing the container; and an acoustic mixer for vibrating the container, toner particles and carrier particles at a resonant frequency.

2. The apparatus according to claim 1, wherein the resonant frequency is from about 15 Hertz to about 2000 Hertz.

3. The apparatus according to claim 1, wherein the container, toner particles and carrier particles are vibrated from about 10 seconds to about 3 minutes.

4. The apparatus according to claim 1, further comprising an arm configured to move the container from the first and second loader to the sealer.

5. The apparatus according to claim 1, further comprising an arm configured to move the container from to the sealer to the acoustic mixer.

6. The apparatus according to claim 1, further comprising a balance for weighing the container.

7. The apparatus according to claim 1 wherein the container is material selected from the group consisting of a plastic, metal and glass.

8. An apparatus for mixing developer comprising:

a first loader for dispensing a predetermined amount of polyester toner particles into a container a second loader for dispensing a predetermined amount of carrier particles into the container wherein the carrier particles comprise a core selected from the group consisting of a granular zircon, granular silicon, glass, steel, nickel, ferrites, iron ferrites and silicon dioxide;

a sealer for sealing the container; and an acoustic mixer for vibrating the container, toner particles and carrier particles at a resonant frequency.

9. The apparatus according to claim 8, wherein the acoustic mixer provides a g force of from about 2 g to about 100 g.

10. The apparatus according to claim 8, wherein the toner particles comprise emulsion aggregation toner particles.

* * * * *